United States Patent [19]

Järvinen

[11] Patent Number: 4,743,042

[45] Date of Patent: May 10, 1988

[54] SKI FASTENING

[76] Inventor: Jukka Järvinen, Pajutie 7, SF-15540 Villahde, Finland

[21] Appl. No.: 909,845

[22] Filed: Sep. 19, 1986

[30] Foreign Application Priority Data

Sep. 25, 1985 [FI] Finland ..... 853677

[51] Int. Cl.[4] ..... A63C 9/20

[52] U.S. Cl. ..... 280/615; 280/631

[58] Field of Search ..... 280/615, 614, 635, 631, 280/633, 634, 618, 611

[56] References Cited

U.S. PATENT DOCUMENTS 4,365,821 12/1982 Kreyenbuhl ..... 280/615

FOREIGN PATENT DOCUMENTS 884766 7/1949 Fed. Rep. of Germany ..... 280/615
2622966 4/1977 Fed. Rep. of Germany .
2657257 6/1978 Fed. Rep. of Germany ..... 280/614
3320559 12/1983 Fed. Rep. of Germany .
3342158 6/1984 Fed. Rep. of Germany ..... 280/615
760675 3/1976 Finland .
772036 6/1977 Finland .
834372 6/1984 Finland .
7907071 10/1980 France ..... 280/615
7835488 1/1983 France ..... 280/615
2519557 7/1983 France ..... 280/615

*Primary Examiner*—David M. Mitchell
*Attorney, Agent, or Firm*—Andrus, Sceales, Starke & Sawall

[57] ABSTRACT

The invention concerns a ski fastening for fixing a skiing shoe (1) on a ski, said fastening comprising a body part (2) to be fixed on the ski and a catch member (3) pivotally attached to the body part and with the aid of which, by mediation of an eye-like hook member (4) on the skiing shoe the shoe becomes fixed to the body part (2). The surface of the body part (2) abutting on the shoe tip forms a wedge-like surface (6) substantially conforming to the tip (5) of the shoe and tapering in the direction forward. In the narrowest part of the surface (6), the front part (7), has been provided for the hook member (4) an aperture (8). Furthermore, the catch member (3) comprises a locking claw (9) of curved shape for locking the hook member (4) that has been pushed through the aperture (8) and, along with it the tip (5) of the skiing shoe (1), to be substantially immovable relative to the body part (2).

7 Claims, 1 Drawing Sheet

SKI FASTENING

Figure 1:
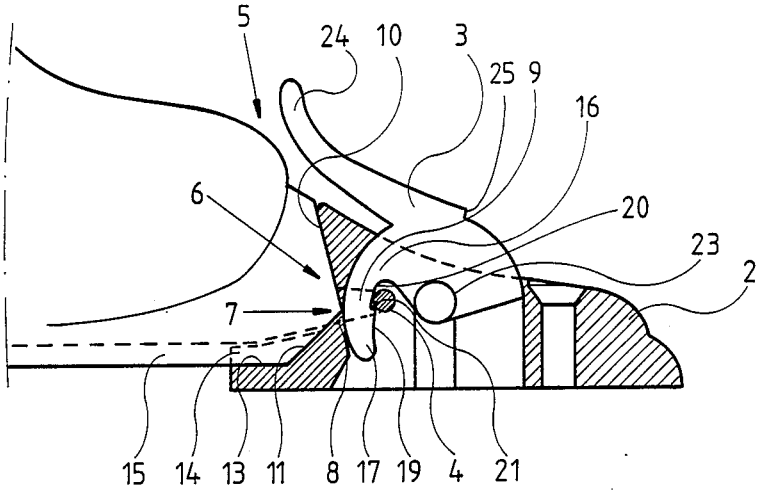

The present invention concerns a ski fastening for cross-country skiing.

As the "skating" or "Siitonen" Style is gaining more and more ground in modern cross-country skiing, the requirements imposd on the fastenings of the ski have also changed and increased. Such ski fastenings are known at present, for instance through the Patents; FR No. 7835488, FR No. 7907071, DE No. 33 20 559 and DE No. 33 42 158, which are screwed or otherwise fixed on the ski. The body part comprises a catch-like locking member, and on the tip of the skiing shoe is an eye, a tongue or another equivalent elongation which is secured to the body part with the aid of the locking member. The shoe is thus elastically secured to the body part and to the ski in the manner implied by conventional cross-country skiing. In addition there may be provided, between the skiing shoe and the ski, a separate intermediate plate, or the body part may continue over the entire extension of the skiing shoe, in which case there is a groove in the sole of the skiing shoe and a corresponding ridge on the intermediate plate of body extension, these tending to keep the skiing shoe in correct position, laterally, on the ski.

It is however a drawback of fastenings of prior art that when a person is skiing using the "skating" mode the fastenings yield excessively both vertically and transversally with the result that the shoe is not properly held upon the ski and, instead, twists in the different phases of ski skating in a manner interfering with the performance. The control and steering of skating-style skiing is hereby impeded and the keeping of rhythm, important in said skiing style, is embarrassed because the skiing person has to pay attention to proper orientation of the shoe in relation to the ski, which actually should be automatically constant throughout the skiing process. A further drawback of tip fastening constructions of prior art is the great width of their design, as a consequence of which, when a person is using the skating style and the skis are in tilted position, the fastenings give rise to extra friction and thus reduce the speed.

The object of the invention is to eliminate the drawbacks mentioned. Especially, the object of the invention is to provide a ski fastening the design of which makes feasible a narrow, and aerodynamic, tip fastening construction which fastens the skiing shoe firmly upon the ski, affording good steerability for the skating style.

The ski fastening of the invention comprises a body part of which the rear face lying against the tip of the skiing shoe is wedge-like so that, at least as viewed from the side, the surface is conical, its upper surface, the supporting face, being rearward inclined and upward oblique and its lower surface, the supporting part, being rearward inclined and downward oblique, and these surfaces being fitted to conform accurately to the shape of the shoe tip. At the point where said surfaces meet, an aperture for a hook member on the tip of the shoe. A catch member, pivotally mounted in the frame part, comprises a wedge-like locking claw which can be inserted in the eye of the hook member pushed into said aperture, whereby the locking claw will pull and urge the shoe tip tight against the rear face of the body part. On the inside surface of the locking claw with curved shape are furthermore provided: a locking shoulder, locking studs or equivalent behind which the eye of the hook member, when snapping in, locks the catch member so that it may not come open for itself.

In an advantageous embodiment of the invention, the supporting part of the rear face and the bottom surface comprise a substantially letter A-shape longitudinal ridge, and the tip of the shoe has a corresponding groove so that they have been disposed to mate closely. Thus, when the shoe tip is urged hard and tight against the rear face of the body part, said ridge will efficiently prevent any lateral movements of the skiing shoe relative to the body part.

In an embodiment of the invention, the locking claw of the catch member is also wedge-shaped in the lateral direction, whereby it causes the eye of the hook member to be urged tight against the body part of the fastening also in the lateral direction, thus affording additional support of the skiing shoe.

The advantage of the invention over ski fastenings of prior art is the firm and stationary fixing of the tip of the skiing shoe to the body part of the fastening. Therefore, even kicks in an oblique direction relative to the surface of the ski cause no slipping of the shoe off the ski, and when the ski is lifted forward it is always in the skiing person's tight control, and correctly oriented. Thus the person need not pay any extra, distracting attention to the position of the skis, as they are always strictly pointed in the direction in which the shoe points. Moreover, the ski fastening of the invention has the advantage of a narrow and aerodynamic design and therefore the fastening will not touch the snow surface and reduce the speed when the ski is tilted.

Figure 2:
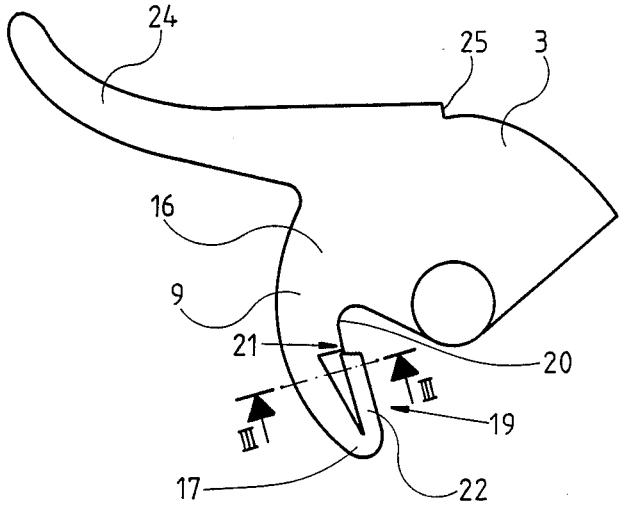

In the following, the invention is described in detail, referring to the attached drawing, wherein:

FIG. 1 presents a ski fastening according to the invention,

FIG. 2 presents a catch member according to the invention, and

Figure 3:
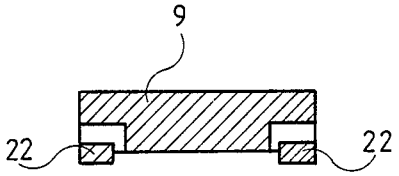

FIG. 3 shows a section of the catch member depicted in FIG. 2.

In FIG. 1 is depicted a ski fastening according to the invention, comprising a body part 2, advantageously consisting of one component, and a catch member 3 pivotally attached to the body part. The body part features a wedge-like surface 6, the rear face, which has been arranged to conform in its shape to the shape of the shoe tip 5. It is thus understood that the wedgelike surface 6 comprises an upward and rearward inclined, oblique supporting surface 10 and a downward and rearward inclined, oblique supporting part 11, these constituting, as viewed from one side, a conical surface, this surface having an aperture 8 in the very forward part 7 of the surface, for the hook member 4 on the tip of the skiing shoe. Hereby, when the tip of the skiing shoe is placed against said conical surface, the hook member will be pushed through the aperture 8 into the body part 2.

Furthermore, the rear face of the body part 2 features an elongated, letter A-shaped ridge 14 bounded by the supporting part 13 and the bottom surface 14, this ridge being arranged to mate with the groove 15 in the lower part of the shoe tip 5.

The catch member 3 is turnably pivoted, with a pivot 23, to the body part 2. The catch member comprises a locking claw 9 with curved shape which can, when the catch member 3 is turned, be pushed into the eye formed by the hook member 4 that has been pushed through the aperture 8, to lock the hook member, and long therewith the tip 5 of the skiing shoe, hard against the body part 2. The locking claw 9 is wedge-like of its design so that its root part 16 is thicker than its point 17, whereby when it becomes wedged in the eye formed by the hook member 4 it will pull and tighten the hook member, as the eye is urged against the inner surface 19 of the locking claw 9 with curved shape. The root 20 of the inner surface 19 features a locking shoulder 21, which is a groove-like recess in which the eye of the hook member 4 becomes locked so that it cannot inadvertently slide back along the inner surface 19 and thus undo the fastening.

The catch member 3 furthermore comprises a handle 24, by the aid of which the catch member can be moved with ease between the locked and open positions. The catch member 3 likewise comprises a supporting shoulder 25 which, when the catch member 3 is in its open position, stops it against the body part 2 so that the catch member cannot become wedged in the body part.

In FIGS. 2 and 3 is depicted an advantageous design of the catch member 3 according to the invention. The locking claw 9 with curved shape of the catch member 3 comprises tongues 22, attaching on its margins to its tip 17 and extending inwardly towards the root 16, running substantially along the inner surface 19, and which are free at the other end. This leaves a recess above the free ends of said tongues, at the root 20 of the inside surface 19, into which the eye of the hook member 4 can be caused to enter and in which it becomes locked so that the ends of the tongues hold the eye in place and the tongues will only be forced inwards and cause release of the eye from the hold of the locking claw when the handle 24 is turned with considerable force.

The invention has been described in the foregoing with reference to certain advantageous embodiments of the invention. These are however in no way restrictive on the invention, of which the different embodiments may vary within the scope of the inventive idea delimited by the claims.

I claim:

1. A ski binding for fastening a skiing shoe (1) on a ski, said skiing shoe having an eye-like hook member (4) on the tip thereof and having a wedge-like exterior configuration when viewed in a vertical plane along the length of the shoe, said binding comprising:

a body part (2) to be fastened on the ski, said body part having an aperture through which the hook member extends when the shoe is fixed in said binding, said body part having a surface (6) containing said aperture and abutting the shoe tip when the shoe is fixed in said binding, said surface substantially conforming to said shoe tip and having an upwardly and rearwardly slanting oblique supporting surface portion (10) above said aperture and a downwardly and rearwardly slanting oblique supporting surface portion (11) below said aperture; and a catch member (3) mounted for pivotal movement on said body part, said catch member including an arcuately curved locking claw (9) extending from a base portion of said catch member, said locking claw (9) having a root (16) adjacent said base portion and a tip (17), said locking claw tapering in width from said root to said tip in wedge-like fashion in a plane normal to the axis of pivotal movement of said catch member, said locking claw being insertable through said hook member and abutting said body part above and below said aperture when said hook member is extended through said aperture and said catch member is pivoted, thereby to pull said shoe tip tight against said surface of said body part.

2. Ski binding according to claim 1 wherein said body part has a bottom surface (13) on which the skiing shoe rests, said bottom surface having a vertically extending, A-shaped longitudinal ridge (14) mating with a corresponding groove (15) in the tip of the skiing shoe for preventing lateral movements of the skiing shoe relative to the body part.

3. Ski binding according to claim 1 wherein said locking claw has an inner surface (19) of its arcuately curved shape, said inner surface engaging said hook member, said inner surface having a step-like locking shoulder for locking the hook member (4) and skiing shoe to said body part.

4. Ski binding according to claim 3 wherein said locking claw has a root adjacent said base portion of said catch member and wherein said locking shoulder is located adjacent said root (20).

5. Ski binding according to claim 3 wherein said locking shoulder comprises at least one spring-like tongue (22) behind which the hook member can be locked.

6. Ski binding according to claim 1 characterized in that the surface (6) comprises substantially vertical marginal surfaces which taper down and approach each other in the forward direction in conformity with the tip (5) of the skiing shoe.

7. Ski fastening according to claim 1 characterized in that the body part (2) consists of a piece having a width substantially at most equal to the width of the ski.

* * * * *